US006564609B2

(12) United States Patent
Amano et al.

(10) Patent No.: US 6,564,609 B2
(45) Date of Patent: May 20, 2003

(54) EQUALIZING FLUID-OPERATED APPARATUS AND METHOD OF ASSEMBLING THE APPARATUS

(75) Inventors: Masayoshi Amano, Okazaki (JP); Shinji Kawamura, Toyota (JP); Sigehiro Kirii, Nagoya (JP); Kazunari Kirii, Nishikam-gun (JP)

(73) Assignees: Kyoho Machine Works, Ltd., Toyota (JP); Toyota Jidosha Kabushiki Kaisha, Toyota (JP)

( * ) Notice: Subject to any disclaimer, the term of this patent is extended or adjusted under 35 U.S.C. 154(b) by 74 days.

(21) Appl. No.: 09/971,705

(22) Filed: Oct. 9, 2001

(65) Prior Publication Data

US 2003/0066330 A1 Apr. 10, 2003

(51) Int. Cl.[7] ..... B21D 24/08
(52) U.S. Cl. ..... 72/351
(58) Field of Search ..... 72/350, 351

(56) References Cited

U.S. PATENT DOCUMENTS 5,419,169 A 5/1995 Kirii
5,660,074 A 8/1997 Kaji
5,960,665 A * 10/1999 Schoellhammer ..... 72/351

FOREIGN PATENT DOCUMENTS

| | | |
|---|---|---|
| DE | 40 16 838 | 11/1991 |
| DE | 41 04 136 | 9/1992 |
| EP | 0 531 141 | 3/1993 |
| JP | 60-108429 | 7/1985 |
| JP | 1-60721 | 4/1989 |

* cited by examiner

*Primary Examiner*—Lowell A. Larson
(74) *Attorney, Agent, or Firm*—Oblon, Spivak, McClelland, Maier & Neustadt, P.C.

(57) ABSTRACT

An equalizing fluid-operated apparatus for use with a pressing machine, the apparatus including a flat common manifold which has bottomed holes having respective bottoms, and a communication passage that communicates the bottomed holes with each other, and rod guides which are integrally and fixedly provided around respective openings of the bottomed holes of the manifold, such that each of the rod guides guides a movement of a piston rod of a corresponding one of fluid-operated cylinders, and prevents the piston rod from coming off the one fluid-operated cylinder, the bottomed holes and the communication passage of the manifold being filled with a working fluid, so that the bottomed holes function as respective pressure chambers of the fluid-operated cylinders.

11 Claims, 9 Drawing Sheets

PRIOR ART

PRIOR ART

EQUALIZING FLUID-OPERATED APPARATUS AND METHOD OF ASSEMBLING THE APPARATUS

BACKGROUND OF THE INVENTION

1. Field of the Invention

The present invention relates in general to an equalizing cushioning apparatus for a pressing machine, and more particularly to an equalizing fluid-operated apparatus which includes a plurality of fluid-operated cylinders and applies substantially equal wrinkling-preventing loads to a workpiece via respective piston rods of the cylinders that are positioned at their neutral positions by a working fluid.

2. Related Art Statement

There is known a pressing machine employing an equalizing cushioning apparatus which includes (a) a cushion pad to which a prescribed movement resistance is applied by a wrinkling-preventing-load applying device, (b) a plurality of fluid-operated cylinders which are provided on the cushion pad and whose pressure chambers are communicated with each other, and (c) a plurality of cushion pins which are interposed between respective piston rods of the fluid-operated, cylinders and a wrinkling-preventing die, and which applies, when the wrinkling-preventing die and an upper movable die cooperate with each other to press a workpiece while preventing wrinkling of the workpiece owing to the above-indicated movement resistance, substantially equal wrinkling-preventing loads to the workpiece via the respective piston rods of the cylinders that are positioned at their neutral positions by a working fluid. In a state in which the wrinkling-preventing die and the upper movable die cooperate with each other to press the workpiece, those two dies are moved with the cushion pad, in a pressing direction relative to a lower fixed die in the form of a punch, against the above-indicated movement resistance, so that the workpiece is worked (i.e., drawn) by a working surface of the punch. This pressing machine is disclosed in, e.g., Japanese Utility Model Document No. 1(1989)-60721, and a pressing machine 8 shown in FIG. 10 is an example of this machine. Even if respective lengths of the cushion pins of the pressing machine may more or less differ from each other, or the cushion pad thereof may be more or less inclined relative to a horizontal plane, the pressing machine can apply substantially equal wrinkling-preventing loads to the respective cushion pins via the respective piston rods of the fluid-operated cylinders that are positioned-at their neutral positions by the working fluid. Therefore, the pressing machine can provide a desirable wrinkling-preventing-load distribution corresponding to a cushion-pin distribution.

More specifically described by reference to the pressing machine 8 shown in FIG. 10, a punch 10 is fixed to a bolster 12 which in turn is supported by a base 16 via a press carrier 14. A movable die 18 is fixed to a press slide 20 which is movable upward and downward by a drive mechanism, not shown. The bolster 12 has, at respective lattice points, respective through-holes 24 through which respective cushion pins 22 extend. A cushion pad 26 which supports the cushion pins 22 is provided below the bolster 12, such that the cushion pad 26 extends in a substantially horizontal plane. The cushion pins 22 cooperate with one another to support a wrinkling-preventing die 28 (i.e., a wrinkling-preventing ring) which is provided in the vicinity of the punch 10. An arbitrary number of cushion pins 22 are provided at respective prescribed positions, depending upon a specific shape of the wrinkling-preventing die 28. The punch 10 has a plurality of through-holes corresponding to the through-holes 24 of the bolster 12. The cushion pad 26 has a plurality of hydraulic cylinders 30 corresponding to the through-holes 24. Respective lower ends of the cushion pins 22 are supported by respective piston rods of the hydraulic cylinders 30. The punch 10 functions as a lower pressing die, the movable die 18 functions as an upper pressing die, and the hydraulic cylinders 30 function as the fluid-operated cylinders.

The cushion pad 26 is provided in the press carrier 14, such that the pad 26 is movable upward and downward, and is normally biased upward by an air-operated cylinder 32. A pressure chamber of the air-operated cylinder 32 is communicated with an air tank 34 which in turn is supplied with pressurized air from a pressurized-air supply 36 via an air-pressure control circuit 38. The air tank 34 is connected to a shut-off valve 37 and to an air-pressure sensor 39, so that an air pressure Pa in the air tank 34 or the air-operated cylinder 32 is controlled depending upon a desired wrinkling-preventing load. More specifically described, when the movable die 18 is moved downward with the press slide 20, the movable die 18 cooperates with the wrinkling-preventing die 28 to sandwich an outer peripheral portion of a workpiece 40, while preventing wrinkling of the workpiece 40 owing to a biasing force resulting from the air pressure Pa in the air-operated cylinder 32. When the movable die 18 and the wrinkling-preventing die 28 are further moved downward with the cushion pad 26, against the biasing force of the air cylinder 32, the workpiece 40 is drawn by a working surface of the punch 10. In the present pressing machine, the air-operated cylinder 32, the air tank 34, the pressurized-air supply 36, and the air-pressure control circuit 38 cooperate with one another to provide a wrinkling-preventing-load applying device 42; and the biasing force of the air-operated cylinder 32, i.e., the air pressure Pa provides a movement resistance applied to the cushion pad 26. In addition, the air-operated cylinder 32 provides a gas-operated cylinder, or a fluid-operated cylinder that utilizes a pressurized fluid.

Respective hydraulic chambers (i.e., pressure chambers) of the hydraulic cylinders 30 are communicated via an fluid passage 46 with one another, and the fluid passage 46 is connected via a flexible tube 48 to a piping 50. A working fluid which is pumped up from a tank 54 by an air-driven hydraulic pump 52, is supplied via a check valve 56 to the piping 50. The piping 50 is connected to a hydraulic-pressure control circuit 58 including a relief valve, etc. The hydraulic-pressure control circuit 58 cooperates with the hydraulic pump 52 to control a hydraulic pressure Ps of the working fluid present in the piping 50 and the hydraulic cylinders 30, to a value which assures that the respective piston rods of all the hydraulic cylinders 30 that are involved in preventing wrinkling during drawing, i.e., the cylinders 30 that support the cushion pins 22, are kept at their neutral positions. Thus, the cushion pins 22 transmit equal wrinkling-preventing loads to the wrinkling-preventing die 28. The hydraulic pressure Pa is detected by a hydraulic-pressure sensor 60 which is connected to the fluid passage 46. In the present pressing machine, the cushion pins 22, the cushion pad 26, the hydraulic cylinders 30, and the wrinkling-preventing-load applying device 42 cooperate with one another to provide an equalizing cushioning apparatus 44.

The hydraulic pressure Ps and the air pressure Pa are controlled by a control device, not shown. Before a pressing operation is started, e.g., when the current pair of pressing dies are exchanged with another pair of pressing dies, the hydraulic pressure Ps and the air pressure Pa are controlled or adjusted to respective appropriate pressure values $Ps_0$, $Pa_0$. The hydraulic pressure $Ps_0$ is determined in a "trial" pressing operation or according to a mathematical expression, so that the respective piston rods of the hydraulic cylinders 30 may be positioned at their neutral positions during the pressing operation. In the latter case, the hydraulic pressure $Ps_0$ is so determined as to satisfy the following expression (1):

$$Xav=(Fs-n\cdot As\cdot Ps_0)V/n^2\cdot As^2\cdot K \quad (1)$$

where

Xav is an average forced-movement distance of the piston rod of each hydraulic cylinder 30;

As is a pressure-receiving area of each hydraulic cylinder 30;

K is a modulus of elasticity of volume of a working fluid used;

V is a volume of the working fluid;

Fs is a wrinkling-preventing load; and n is a number of the cushion pins 22 used, i.e., a number of the hydraulic cylinders 30 used to prevent wrinkling.

The average forced-movement distance Xav is a stroke of movement of the piston rod of each hydraulic cylinder 30 that assures that all the cushion pins 22 act on the wrinkling-preventing die 28, and is experimentally determined, in advance, such that even if the cushion pins 22 may have different dimensions or the cushion pad 26 may be inclined, the respective piston rods of all the hydraulic cylinders 30 are forced into the respective cylinders by the corresponding cushion pins 22, but do not reach their stroke ends. The volume V of the working fluid is a volume of all the working fluid that fills the respective hydraulic chambers of all the hydraulic cylinders 30 and a series of hydraulic circuits communicating with those hydraulic chambers, in the state in which the respective piston rods of the cylinders 30 are positioned at their advancement ends.

The air pressure $Pa_0$ is determined to obtain a desired wrinkling-preventing load Fs, according to the following expression (2):

$$Pa_0=(Fs+Wc+n\cdot Wp+Wr-\Delta Fc)/Aa \quad (2)$$

where

Aa is a pressure-receiving area of the air-operated cylinder 32;

Wc is a weight of the cushion pad 26;

ΔFc is a movement resistance applied to the cushion pad 26;

n is the number of the cushion pins 22;

Wp is a weight of each cushion pin 22; and

Wr is a weight of the wrinkling-preventing die 28.

The wrinkling-preventing load Fs is determined, in advance, in a trial pressing operation, so as to obtain a desired quality. Meanwhile, in a pressing operation, as the cushion pad 26 is moved downward, the volume of air decreases and accordingly the air pressure Pa increases. Thus, it is possible to determine an initial air pressure $Pa_0$ which assures that a desired air pressure Pa is established when the cushion pad 26 is positioned at its lower dead position.

FIG. 11 shows another equalizing fluid-operated apparatus 62 including a flat manifold 64 having a hydraulic passage 46, and a plurality of hydraulic cylinders 30 integrally assembled with the flat manifold 64. According to this technique, the hydraulic cylinders 30 can be easily and quickly attached to the upper surface of the cushion pad 26. The manifold 64 has a plurality of communication holes 66 each communicating with the hydraulic passage 46. A housing 68 of each of the hydraulic cylinders 30 has a projecting portion 70 which fits in a corresponding one of the communication holes 66. In the state in which the projecting portion 70 of each hydraulic cylinder 30 fits in one communication hole 66, the housing 68 of the each cylinder 30 is integrally fixed to the manifold 62 with bolts, not shown. The housing 68 of each hydraulic cylinder 30 has a bottom hole 72, and a rod guide 76 which guides an axial movement of a cylinder rod 74 is threadedly engaged with an inner surface of the housing 68. Thus, each hydraulic cylinder 30 has a hydraulic chamber (i.e., a pressure chamber) 78 communicating with the hydraulic passage 46. The cylinder rod 74 includes a large-diameter portion 80 as an integral lower-end portion thereof. The large-diameter portion 80 can engage a lower-end surface of the guide rod 76, thereby preventing the cylinder rod 74 from coming off the housing 68.

However, if the hydraulic cylinders 30 are provided on the manifold 64 in the above-described manner, a height H of the equalizing fluid-operated apparatus 62 as a whole considerably increases. Therefore, this technique cannot be applied to some conventional pressing machines. More specifically described, in a certain conventional pressing machine which does not employ an equalizing apparatus, a wafer plate is fixed to an upper surface of a cushion pad 26 and cushion pins 22 are provided on the wafer plate. Accordingly, after the wafer plate is removed from the cushion pad 26, the equalizing fluid-operated apparatus 62 is provided on the pad 26. However, in the case where the height H of the apparatus 62 is too great and the apparatus 62 cannot be attached to the pad 26 as they are, the pad 26 needs to be exchanged with a thinner one or may even be reformed. This is very cumbersome and timing-consuming.

SUMMARY OF THE INVENTION

It is therefore an object of the present invention to provide an equalizing fluid-operated apparatus which enjoys a minimized height by assembling a plurality of fluid-operated cylinders in a manifold.

The above object has been achieved by the present inventions. According to a first invention, there is provided an equalizing fluid-operated apparatus for use with a pressing machine including a pressing die; a cushion pad to which a prescribed movement resistance is applied by a wrinkling-preventing-load applying device; a plurality of fluid-operated cylinders which are provided on the cushion pad and are filled with a working fluid and which have respective piston rods, and respective pressure chambers communicated with each other; a wrinkling-preventing die; and a plurality of cushion pins which are provided between the corresponding piston rods of the fluid-operated cylinders and the wrinkling-preventing die, so that when the wrinkling-preventing die cooperates with the pressing die to sandwich a workpiece owing to the movement resistance applied to the cushion pad, the respective piston rods of the fluid-operated cylinders are forced into the corresponding pressure chambers thereof to take respective neutral positions in the pressure chambers, and the working fluid applies substantially equal wrinkling-preventing loads to the workpiece via the respective cushion pins, the apparatus comprising (a) a flat common manifold which is provided on the cushion pad and which has a plurality of bottomed holes having respective bottoms, and a communication passage that communicates the bottomed holes with each other; and (b) a plurality of rod guides which are integrally and fixedly provided around respective openings of the bottomed holes of the manifold, such that each of the rod guides guides a movement of the piston rod of a corresponding one of the fluid-operated cylinders in a direction parallel to an axis line of the piston rod, and prevents the piston rod from coming off the one fluid-operated cylinder, the bottomed holes and the communication passage of the manifold being filled with the working fluid, so that the bottomed holes function as the respective pressure chambers of the fluid-operated cylinders.

In this equalizing fluid-operated apparatus, the bottomed holes of the manifold provide the respective pressure chambers of the fluid-operated cylinders, and the rod guides are integrally and fixedly provided around the respective openings of the bottomed holes, so as to hold the respective piston rods such that each of the piston rods is movable relative to a corresponding one of the rod guides in an axial direction of the each piston rod and is prevented from coming off the one rod guide. Therefore, the whole apparatus including the manifold has a minimized height and accordingly can be employed, as it is, in many conventional pressing machines. In addition, since the manifold functions as the respective housings of the fluid-operated cylinders, the pressure-receiving area (i.e., the above-described pressure-receiving area As) of each piston rod, that is, the diameter of a portion of each piston rod that is held by the rod guide can be increased without having to lower the density of distribution of the fluid-operated cylinders, and the pressure of the working fluid (i.e., the above-described hydraulic pressure $Ps_0$) can be lowered as such. Thus, the respective required strengths or sealing performances of the respective constituent elements can be lowered.

The present equalizing fluid-operated apparatus is preferably employed in, e.g., the pressing machine 8 shown in FIG. 10. More specifically described, the movable die 18 is an upper pressing die, and is moved downward toward the fixed punch 10 as a lower pressing die. The equalizing fluid-operated apparatus is provided on the cushion pad 26 to which a downward-movement resistance as the movement resistance is applied. The cushion pins 22 are provided on the respective piston rods of the fluid-operated cylinders, and cooperate with one another to support, at their upper ends, the wrinkling-preventing die 28. However, one of the two pressing dies may be moved relative to the other die, in a direction other than a vertical direction, so as to perform a pressing operation.

The wrinkling-preventing-load applying device is preferably provided by a fluid-operated cylinder in which a pressurized fluid is used, e.g., a gas-operated cylinder, e.g., the air-operated cylinder 32 employed in the pressing machine 8 shown in FIG. 10. The movement resistance is applied by the pressure of the fluid, e.g., the air pressure. However, other sorts of wrinkling-preventing-load applying devices may be employed, such as one which utilizes an elastic force of, e.g., a spring member, or one which allows a fluid such as oil to flow at a prescribed relief pressure and thereby produces a movement resistance.

Each of the fluid-operated cylinders is preferably provided by a hydraulic cylinder. However, it is possible to employ other sorts of fluid-operated cylinders than the hydraulic cylinder. For example, a fluid-operated cylinder in which a liquid other than oil, or a gel, is used may be employed. A fluid circuit which communicates the fluid-operated cylinders with each other may be constructed such that the fluid circuit can be shut off by, e.g., the check valve 56 employed in the pressing machine 8 shown in FIG. 10. When a pressing operation is performed, the working fluid is inhibited from coming into the fluid circuit or going out of the same, except that the working fluid flows into the fluid circuit through the check valve. The volume of the fluid circuit is maintained at a prescribed value, except that the respective volumes of the fluid-operated cylinders may be changed with the action of pressing (or the prevention of wrinkling). However, the fluid circuit may be constructed in other manners, for example, in a manner in which the working fluid is relieved, during the action of pressing, so as to cause the piston rods to be positioned at their neutral positions. In short, according to this invention, it is essential that in a pressing operation the piston rods are positioned at their neutral positions and substantially equal wrinkling-preventing loads are applied by the working fluid.

Each of the piston rods may be one which includes a large-diameter portion which is integral with a remaining portion of the each piston rod and is provided in an end portion thereof located on the side of the pressure chamber. The large-diameter portion engages the rod guide and thereby prevents the each piston rod from coming off the rod guide in an advancement direction of the piston rod. The large-diameter portion may engage the rod guide in any one of various manners each of which assures that the piston rod is prevented from coming off the rod guide in the advancement direction.

The manifold may have, at respective lattice points, the respective bottomed holes functioning as the respective pressure chambers of the fluid-operated cylinders. However, the pattern of distribution of the fluid-operated cylinders may be selected from various patterns. For example, in the case where the manifold has an elongate shape, the fluid-operated cylinders may be arranged in a single array in the elongate manifold.

According to a second invention relating to the first invention, the piston rod of each of the fluid-operated cylinders has, in an end surface thereof located on a side of a corresponding one of the bottomed holes, a recess which accommodates a prescribed volume of the working fluid.

According to the second invention, the piston rods have, in the respective end surfaces thereof, the respective recesses which cooperate with each other to accommodate the prescribed volume of the working fluid (i.e., the above-described volume V of the working fluid). Thus, the manifold may be provided by a thin member having shallow bottomed holes, which contributes to decreasing the height of the equalizing fluid-operated apparatus as a whole. In addition, the volume of the working fluid can be adjusted, depending upon the wrinkling-preventing load Fs, the number n of the cushion pins used, or the modulus K of elasticity of volume of the working fluid, by exchanging the current sort of piston rods with a different sort of piston rods each having a recess of a different size, without having to exchange the current sort of manifold with a different sort of manifold having a different size.

According to a third invention relating to the third invention, the piston rod of the each fluid-operated cylinder has an air-relief hole which communicates, at one of opposite ends thereof, with a bottom of the recess and opens, at the other end thereof, in a side surface of the piston rod.

According to the third invention, the piston rod has the air-relief hole communicating with the bottom of the recess and opening in the side surface of the piston rod. Therefore, in the case where the piston and the rod guide are integrally assembled with the manifold whose bottomed holes are filled, in advance, with the working fluid, according to an eleventh invention, described later, the assembling operation can be easily performed without leaving air in the recess or the air-relief hole of the piston rod.

According to the third invention, the piston rod has the recess, and the air-relief hole communicating with the recess. However, according to the second invention, the piston rod does not need the air-relief hole. For example, according to a tenth invention, described later, it is possible to assemble the piston rod without the air-relief hole, such that no air is left in the recess of the piston rod. According to the first invention, the piston rod does not need the recess or the air-relief hole.

According to a fourth invention relating to any one of the first to third inventions, the fluid-operated cylinders are supported by the cushion pad of the pressing machine such that an upper end portion of the piston rod of each of the fluid-operated cylinders projects vertically upward from a corresponding one of the rod guides, and the apparatus further comprises a covering device which is provided on the upper end portion of the piston rod of the each fluid-operated cylinder that projects vertically upward from the one rod guide and which prevents foreign matters from entering an interface of respective sliding surfaces of the piston rod and the one rod guide.

According to the fourth invention, the covering device, provided on the upper end portion of the piston rod, prevents the foreign matters from entering the interface of respective sliding surfaces of the piston rod and the corresponding rod guide. Thus, the problem that the working fluid may leak because of the scars or scratches produced by the foreign matters can be prevented, and the excellent life expectancy can be enjoyed.

According to the fourth invention, the piston rod is supported by the pressing machine such that the piston rod extends vertically upward. However, this feature is not essentially needed according to any other invention.

According to a fifth invention relating to the fourth invention, the covering device comprises a dust cover which includes a bottom portion that extends outward from the piston rod of the each fluid-operated cylinder and reaches a position corresponding to an outer periphery of the one rod guide, and additionally includes a tubular side portion that is integral with the bottom portion, extends downward from an outer periphery of the bottom portion along a side surface of the one rod guide, and has a shape corresponding to a shape of the side surface of the one rod guide.

According to the fifth invention, there is left some space between the tubular side portion of the duct cover and the rod guide. However, it is possible to provide a stretchable, elastic seal member, such as a rubber seal member, between an open end of the tubular side portion of the dust cover and the side surface of the rod guide, and thereby substantially air-tightly seal the space left between the dust cover and the rod guide. The tubular side portion of the duct cover may have any shape corresponding to the shape of the side surface of the rod guide; such as a cylindrical shape or a rectangular (i.e., box-like) shape.

According to the fifth invention, the dust cover may be fixed, with, e.g., bolts, to the upper end portion of the piston rod, such that the bottom portion of the dust cover completely covers the upper end portion. In this case, the cushion pin is placed on the bottom portion of the dust cover. However, the bottom portion of the dust cover may have a through-hole in the central portion thereof, and the dust cover may be fixed to the upper end portion of the piston rod such that an upper end surface of the piston rod is exposed through the through-hole of the bottom portion of the dust cover. In the latter case, the cushion pin is placed on the exposed, upper end surface of the piston rod.

According to a sixth invention relating to the fourth invention, the covering device comprises an annular dust seal which is formed of a stretchable thin elastic material, which includes an inner peripheral portion that is attached to an outer peripheral portion of the upper end portion of the piston rod of the each fluid-operated cylinder, and additionally includes an outer peripheral portion that is held in contact with the one rod guide even when the piston rod is displaced upward and downward, and which prevents the foreign matters from entering the interface of the respective sliding surfaces of the piston rod and the one rod guide.

According to the sixth invention, the annular dust seal, formed of the stretchable thin elastic material, is used as the covering device, which contributes to decreasing the cost.

According to the sixth invention, the dust seal is substantially positioned in a flat plane, for example, in a state in which the piston rod is retracted in the fluid-operated cylinder. On the other hand, in a state in which the piston rod is advanced and is projected upward, the dust seal takes a truncated-conical shape. Therefore, an initial shape of the dust seal, i.e., a formed shape of the same may be one which is positioned in a plane or one which is like a truncated cone. In the case where the dust seal has the truncated-conical initial shape, an outer peripheral portion of the dust seal is more effectively held in close contact with an upper end surface of the rod guide. In this case, the dust seal having the truncated-conical initial shape may be one which can substantially maintain its initial shape even in the state in which the piston rod is retracted in the fluid-operated cylinder.

According to a seventh invention relating to the sixth invention, the piston rod of the each fluid-operated cylinder has, in a side surface thereof, an annular groove, and the inner peripheral portion of the dust seal is fitted in, and attached, to, the annular groove, and the outer peripheral portion of the dust seal is held, owing to an own weight thereof, in contact with an upper end surface of the one rod guide even when the piston rod is displaced upward and downward.

According to the seventh invention, the piston rod has, in its side surface, the annular groove, and the inner peripheral portion of the dust seal is fitted in, and attached, to, the annular groove, and the outer peripheral portion of the dust seal is held, owing to its own weight, in contact with the upper end surface of the rod guide even when the piston rod is displaced upward and downward. Therefore, the dust seal can be easily attached to the piston rod, and can be easily exchanged with another dust seal.

According to the seventh invention, the inner peripheral portion of the dust seal is fitted in, and attached, to, the annular groove of the piston rod, and the outer peripheral portion of the dust seal is held, owing to its own weight, in contact with the upper end surface of the rod guide in spite of the upward and downward displacement of the piston rod. However, according to the sixth invention, the rod guide may have, in its upper end surface, an annular groove in and to which the outer peripheral portion of the dust seal may be fitted and attached, or a fixing means such as bolts may be used to fix the dust seal to at least one of the piston rod and the rod guide. Thus, at least one of the inner and outer peripheral portions of the dust seal may be fixed to at least one of the piston rod and the rod guide, in any appropriate manner.

The upper end surface of the rod guide may be defined by a flat surface that is perpendicular to the central axis line of the piston rod. However, the upper end surface of the rod guide may be defined by a tapered surface which is inclined downward in a direction away from the piston rod. In the latter case, foreign matters such as oil or dust do not accumulate on the upper end surface, but slip down toward the side surface of the rod guide. Thus, the foreign matters are more effectively prevented from entering the interface of respective sliding surfaces of the piston rod and the rod guide.

According to an eighth invention relating to the sixth or seventh invention, at least one of the inner and outer peripheral portions of the dust seal comprises a thickened portion having a thickness greater than a thickness of a remaining portion of the dust seal.

According to the eighth invention, one or each of the inner and outer peripheral portions of the dust seal includes the thickened portion. In the case where the inner peripheral portion includes the thickened portion, the inner portion enjoys a higher strength, which contributes to enabling a worker to more easily fit the inner portion in the annular groove of the piston rod, employed according to the seventh invention, and to preventing more effectively the inner portion from coming off the annular groove. In the case where the outer peripheral portion includes the thickened portion, the outer portion enjoys a higher strength, which contributes, in the case where the rod guide has an annular groove in an upper end surface thereof, to enabling a worker to more easily fit the outer portion in the annular groove of the rod guide. In addition, in the case where the outer peripheral portion of the dust seal is held owing to its own weight in contact with the upper end surface of the rod guide, e.g., according to the seventh invention, the outer portion including the thickened portion has an increased own weight which contributes to holding more effectively the outer portion on the upper end surface of the rod guide and thereby more effectively preventing the invasion of the foreign matters.

According to the eighth invention, the thickened portion is preferably provided by a "circular" lip having a substantially circular cross section. However, the thickened portion may be one which has a different cross section. The thickened portion may be substantially symmetrical with respect to a horizontal plane. However, the thickened portion provided as the outer peripheral portion may be one which is thickened only on the side of its lower surface that contacts the upper end surface of the rod guide. This design contributes to preventing foreign matters from accumulating on the dust seal. In addition, in the case where the outer peripheral portion of the dust seal is just placed on the upper end surface of the rod guide, e.g., according the seventh invention, this design effectively prevents the outer portion of the dust seal from warping upward (or rolling upward), and thereby increases the sealing performance of the dust seal. When the diameter of the outer peripheral portion of the dust seal decreases and increases as the piston rod displaces upward and downward, in particular, when the diameter increases as the piston rod displaces downward, the outer peripheral portion may warp upward because of the resistance to the change of diameter. However, if the outer peripheral portion is thickened on the side of its lower surface only so as to have a generally L-shaped cross section, the elasticity of the thickened portion effectively prevents the thickened portion itself from warping toward the side of its upper surface opposite to the side of its lower surface.

According to a ninth invention, there is provided a method of assembling an equalizing fluid-operated apparatus according to any one of the first to eighth inventions, comprising the steps of (a) holding the manifold such that the bottomed holes thereof open upward, so as to fill the bottomed holes and the communication passage of the manifold with the working fluid, and (b) inserting each of the piston rods into a corresponding one of the bottomed holes filled with the working fluid, without leaving air in the one bottomed hole, and fixing a corresponding one of the rod guides to a portion of the manifold around an opening of the one bottomed hole.

According to the ninth invention, in the state in which the bottomed holes and the communication passage of the manifold is filled with the working fluid, the piston rods are inserted and the rod guides are fixed. Thus, the piston rods and the rod guides can be assemble with the manifold without leaving any air in the bottomed holes.

According to a tenth invention, there is provided a method of assembling an equalizing fluid-operated apparatus according to the second or third invention, comprising the steps of (a) holding the manifold such that the bottomed holes thereof open upward, so as to fill the bottomed holes and the communication passage of the manifold with the working fluid, filling the recess of each of the piston rods with the working fluid, and closing, with a closing member, an opening of the recess of the each piston rod, and (b) moving the each piston rod to a position above a corresponding one of the bottomed holes, in a state in which the recess of the each piston rod filled with the working fluid is oriented downward, removing the closing member in a state in which the closing member contacts, or is immersed in, the working fluid filling the one bottomed hole, inserting the each piston rod into the one bottomed hole, and fixing a corresponding one of the rod guides to a portion of the manifold around an opening of the one bottomed hole.

Each of the tenth invention, and an eleventh invention, described below, substantially corresponds to an embodiment of the ninth invention, and accordingly enjoys the same advantages as those of the ninth invention. In addition, according to the tenth invention, the piston rods whose recess are filled with the working fluid are assembled with the manifold. Therefore, no air is left in the recesses of the piston rods.

According to an eleventh invention, there is provided a method of assembling an equalizing fluid-operated apparatus according to the third invention, comprising the steps of (a) holding the manifold such that the bottomed holes thereof open upward, so as to fill the bottomed holes and the communication passage of the manifold with the working fluid, and (b) inserting each of the piston rods into a corresponding one of the bottomed holes filled with the working fluid, till the air-relief hole of the each piston rod is immersed in the working fluid filling the one bottomed hole, while allowing air to be relieved from the air-relief hole and the recess of the each piston rod and allowing the working fluid to flow into the recess and the air-relief hole, and fixing a corresponding one of the rod guides to a portion of the manifold around an opening of the one bottomed hole.

According to the eleventh invention, each of the piston rods has the air-relief hole at the bottom of the recess thereof. Therefore, when the piston rods are assembled with the manifold, the air present in the recesses is relieved through the air-relief holes. Thus, the piston rods can be easily assembled with the manifold, without needing to filling the recesses of the piston rods, in advance, in contrast to the tenth invention.

The assembling methods according to the ninth to eleventh inventions are just examples, and the equalizing fluid-operated apparatus according to any of the first to eighth inventions may be assembled by a different method.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF PREFERRED EMBODIMENTS

Hereinafter, there will be described an embodiment of the present invention in detail by reference to the drawings.

Figure 1A:
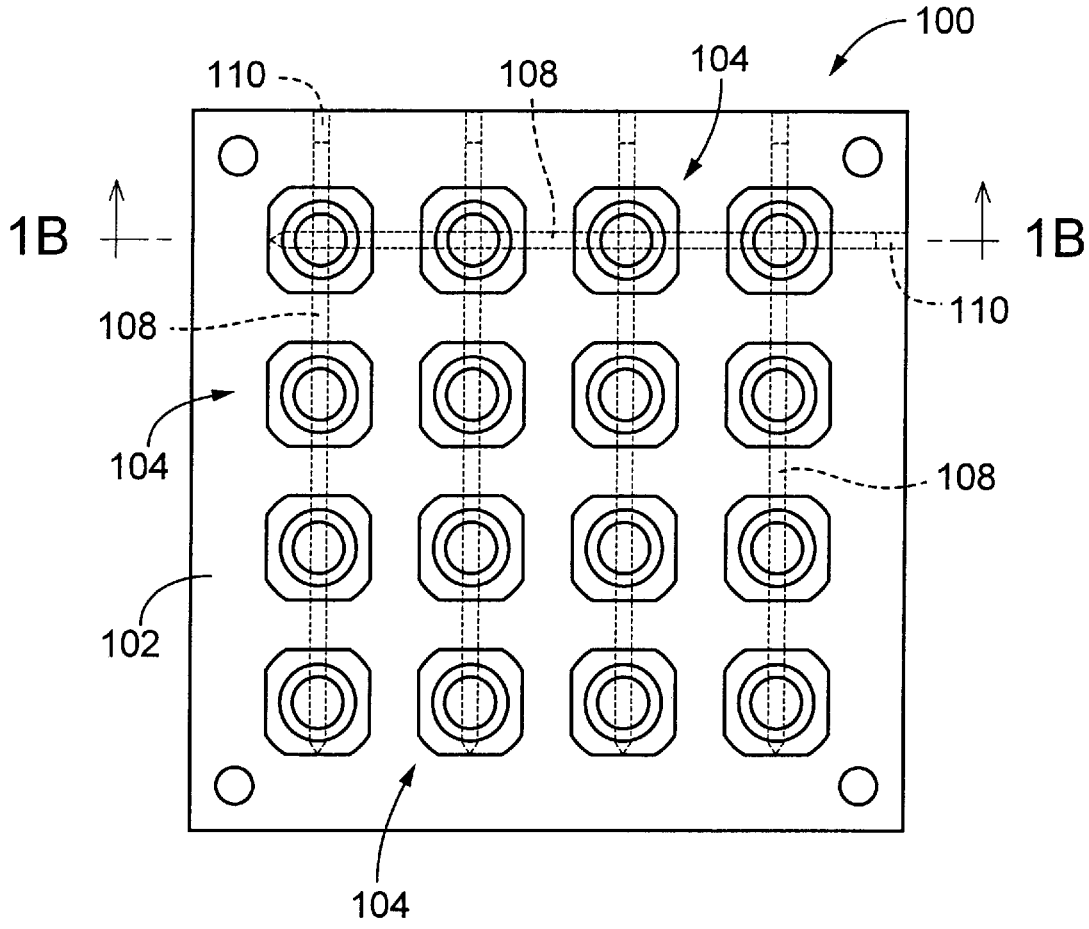
FIG. 1A is a schematic plan view of an equalizing fluid-operated apparatus to which the present invention is applied.
Figure 1B:
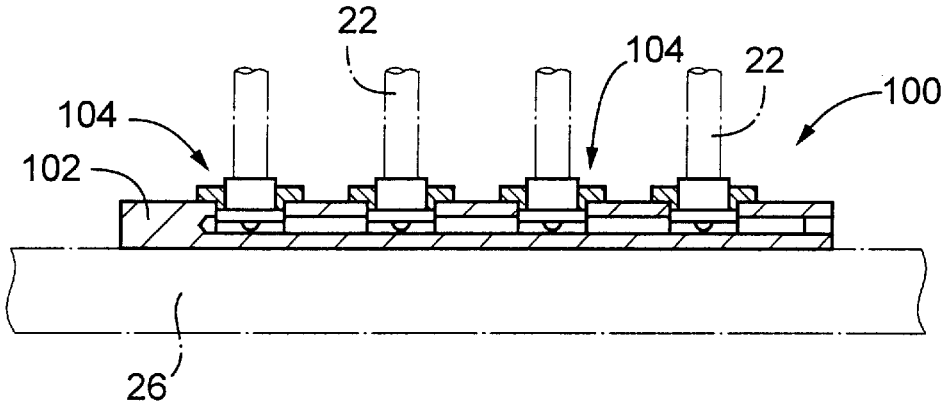
FIG. 1B is a cross-sectioned view of the apparatus of FIG. 1A, taken along line 1B—1B in FIG. 1A.
Figure 2A:
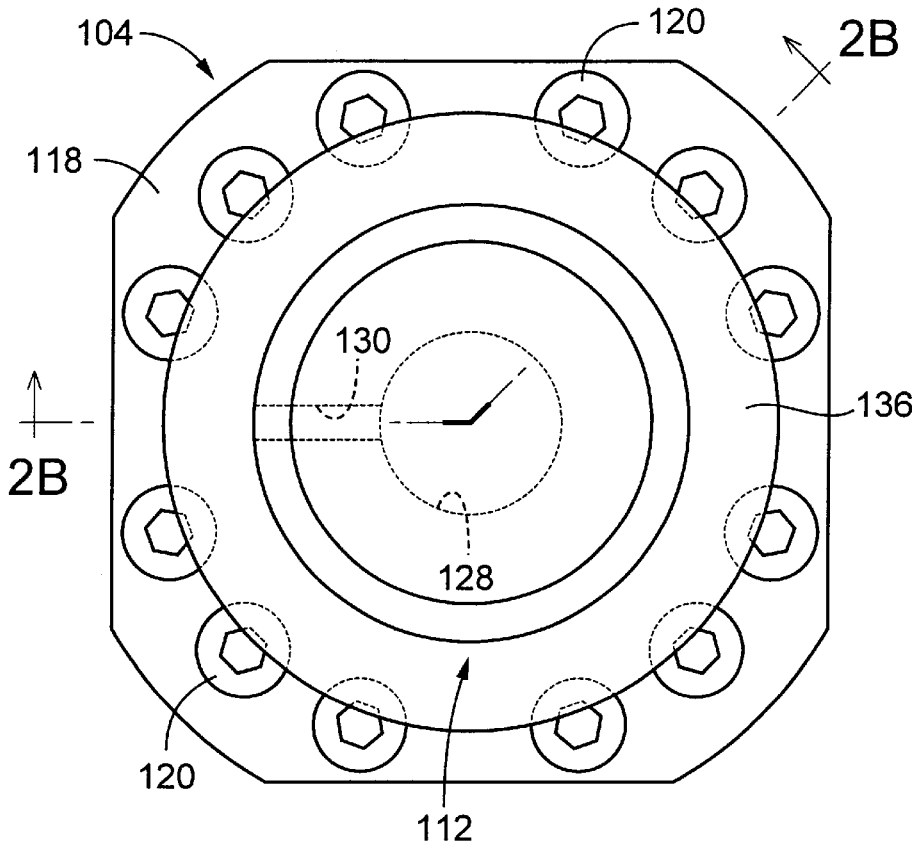
FIG. 2A is a plan view of one fluid-operated cylinder of the apparatus of FIG. 1A.
Figure 2B:
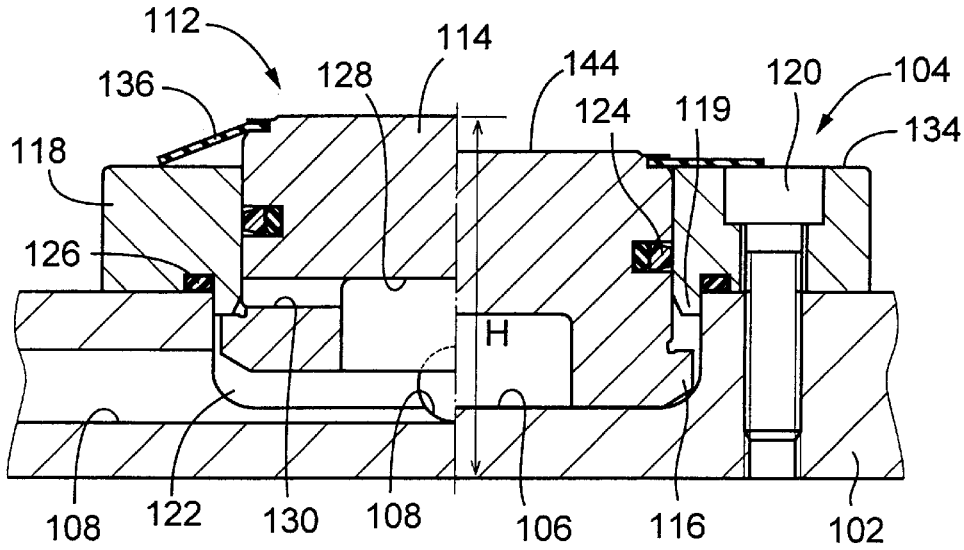
FIG. 2B is a cross-sectioned view of the fluid-operated cylinder of FIG. 2A, taken along lines 2B—2B.
Figure 10:
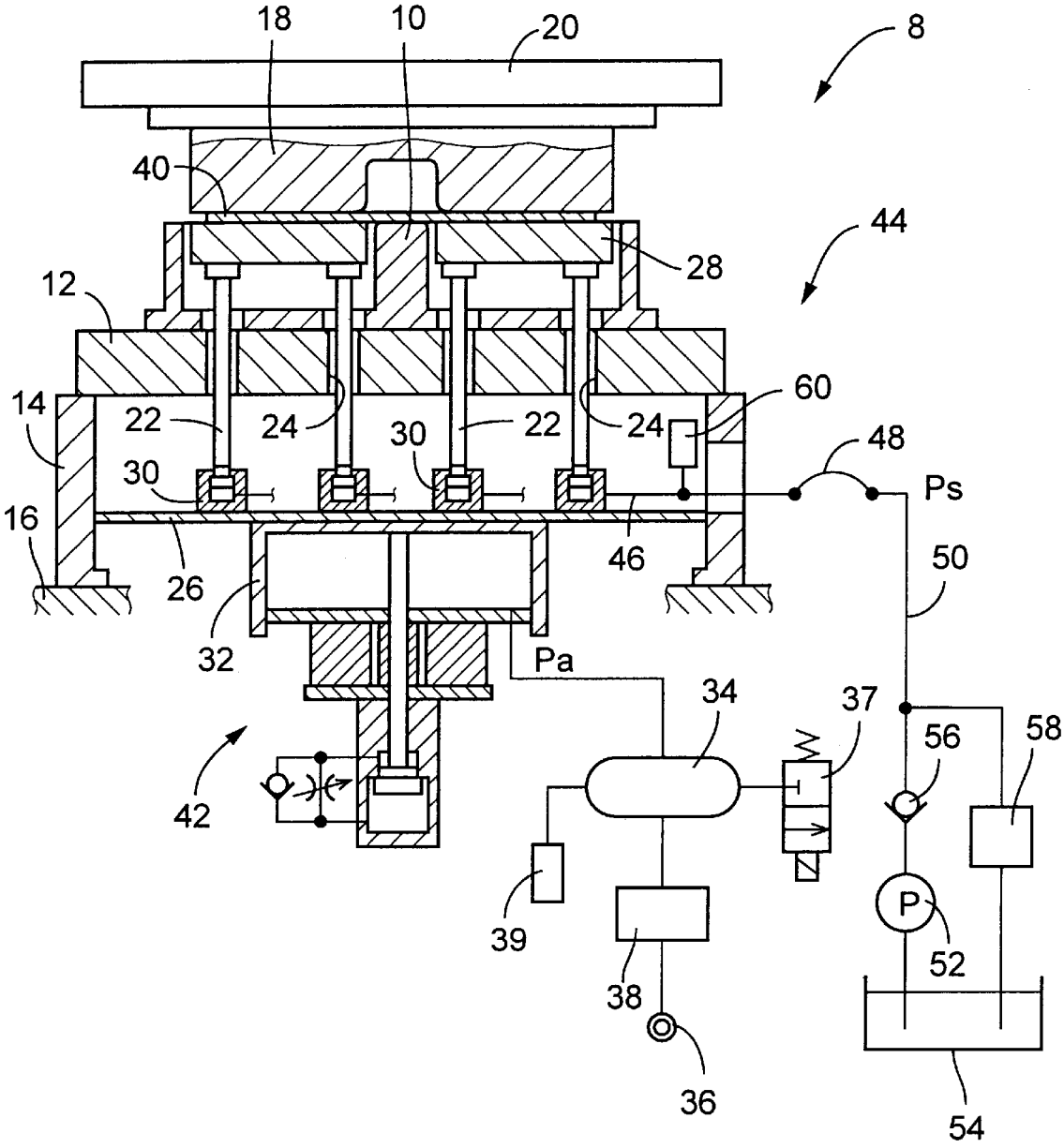
FIG. 10 is a view of a conventional pressing machine.

FIGS. 1A and 1B show an equalizing fluid-operated apparatus 100 to which the present invention is applied. The present apparatus 100 is used by being integrally provided on the cushion pad 26 of the pressing machine 8, shown in FIG. 10, in place of the hydraulic cylinders 30. The present apparatus 100 includes a flat common manifold 102, and a plurality of (e.g., sixteen) hydraulic cylinders 104 which are integrally assembled with an upper portion of the manifold 102 at respective lattice points thereof. Each of the hydraulic cylinders 104 is constructed as shown in FIGS. 2A and 2B. The total number of the hydraulic cylinders 104 assembled with the manifold 102 may be changed as needed. It is possible to provide and use a plurality of equalizing fluid-operated apparatuses 100 on the single cushion pad 26 of the pressing machine 8. The hydraulic cylinders 104 correspond to the fluid-operated cylinders.

The manifold 102 has a plurality of bottomed holes 106 at the above-indicated lattice points where the hydraulic cylinders 104 are provided; and a plurality of communication passages 108 which communicate the bottom holes 106 with each other. As is apparent from FIG. 1A, the communication passages 108 are formed by boring starting with side surfaces of the manifold. Respective openings of the passages 108 are fluid-tightly closed by respective externally threaded screws 110, except for at least one passage 108 which is connected to the flexible tube 48, so that the hydraulic pressure can be controlled.

Each of the hydraulic cylinders 104 includes a piston rod 112 which includes a cylindrical main portion 114 and a large-diameter portion 116 which is integral with the main portion 114 and has a diameter larger than that of the same 114. The piston rod 112 is inserted in one bottomed hole 106, such that the large-diameter portion 116 of the rod 112 defines a lower end portion of the rod 112. A rod guide 118 fits on an outer circumferential surface of the main portion 114 of the piston rod 112, such that the rod guide 118 is slideable on the main portion 114 in an axial direction of the rod 112. The rod guide 118 is integrally fixed around an opening of the bottomed hole 106 with a plurality of (e.g., twelve) bolts 120, so that the piston rod 112 is movable in an axial direction thereof and is prevented from coming off the hydraulic cylinder 104 in an advancement (i.e., upward) direction. Thus, the bottom hole 106 of the manifold 102 functions as a pressure chamber 122 of the hydraulic cylinder 104. A left-hand half of FIG. 2B shows a state in which the large-diameter portion 116 of the piston rod 112 is positioned at an advancement (i.e., upward-movement) end position thereof where the large-diameter portion 116 engages the rod guide 118, and a right-hand half of FIG. 2B shows a state in which the large-diameter portion 116 is positioned at a forced-movement (i.e., downward-movement) end position thereof where the large-diameter portion 116 engages the bottom of the hole 106.

The rod guide 118 has an annular projection 119 which is integral with a remaining portion thereof and which fits in the bottomed hole 106. In the state in which the projection 119 fits in the hole 106, the rod guide 118 or the piston rod 112 is positioned relative to the manifold 102 such that the guide 118 or the rod 112 is concentric with the hole 106. A rod seal 124 fits in an annular groove formed in the outer circumferential surface of the main portion 114 of the piston rod 112, and fluid-tightly seals between the piston rod 112 and the rod guide 118. An O-ring 126 fits in an annular groove formed in a lower-end surface of the rod guide 118, and fluid-tightly seals between the rod guide 118 and the manifold 102.

Figure 3A:
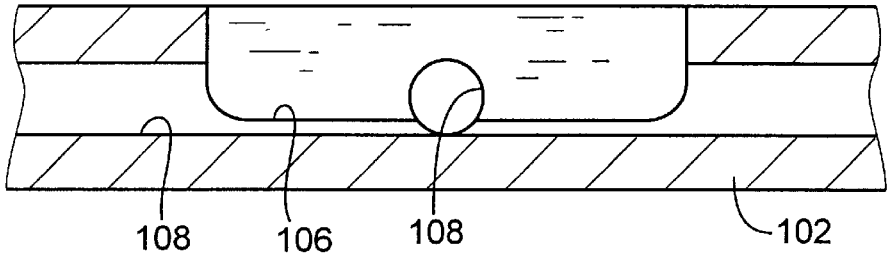
FIG. 3A is a view for explaining a first step of a first assembling method for assembling the apparatus of FIG. 1A.
Figure 3B:
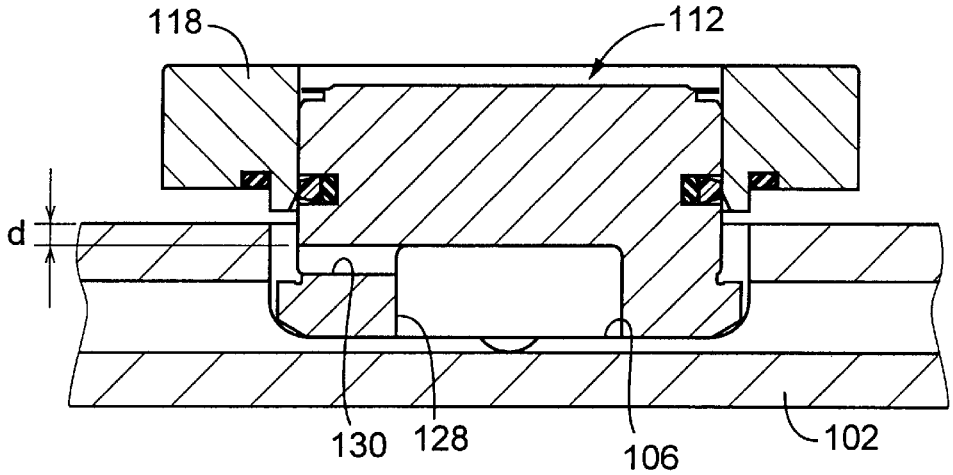
FIG. 3B is a view for explaining a second step of the first assembling method.
Figure 3C:
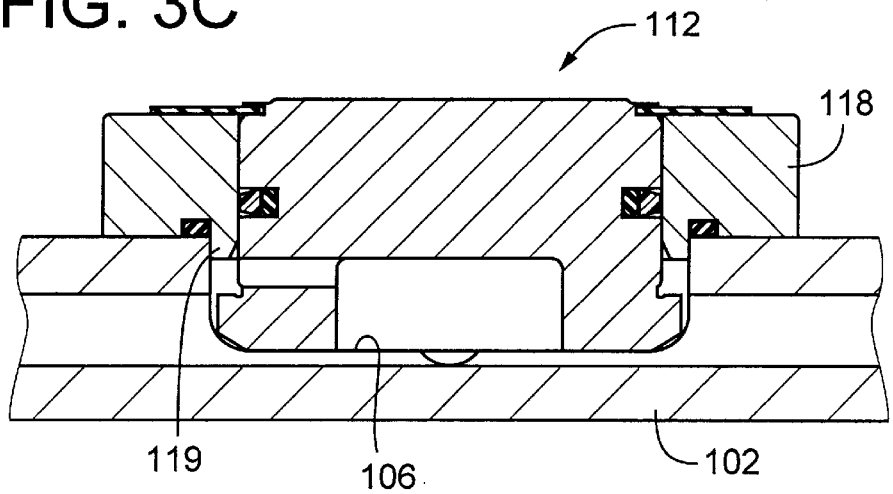
FIG. 3C is a view for explaining a third step of the first assembling method.

The large-diameter portion 116 of the piston rod 112 has, in the lower-end surface of the rod 112, a recess 128 which provides part of the previously-described volume V of the working fluid. An air-relieve hole 130 which communicates with an upper end portion of the recess 128 is formed through the main portion 114 of the piston rod 112, and opens in the outer circumferential surface of the main portion 114. Since air is completely relieved through the air-relief hole 130 when the piston rod 112 and the rod guide 108 are assembled with the manifold 102, no air remains in the recess 128. Thus, the piston rod 112 and the rod guide 108 are easily assembled with the manifold 102. FIGS. 3A, 3B, and 3C show three steps of a first assembling method. In the step shown in FIG. 3A, the manifold 102 is held such that the bottomed holes 106 open upward, and the bottomed holes 106 and the communication passages 108 are filled with the working fluid. In the step shown in FIG. 3B, the piston rods 112 are inserted in the bottomed holes 106, respectively, till the respective large-diameter portions 116 of the piston rods 112 reach the respective bottoms of the holes 106. In this step, the working fluid flows into the recesses 128, while the air flows out of the recesses 128 through the air-relief holes 130. In the state in which the large-diameter portion 116 of each piston rod 112 contacts the bottom of the bottomed hole 106, an upper end of the air-relief hole 130 is distant from an upper end of the bottomed hole 106 by a dimension, d, indicated in FIG. 3B. Thus, the recess 128 and the air-relief hole 130 are filled with the working fluid. The dimension d may be any value greater than zero. In the step shown in FIG. 3C, the respective projections 119 of the rod guides 118 are fitted in the respective bottomed holes 106, and the rod guides 118 are integrally fastened to the manifold 102 with the bolts 120. Thus, the piston rods 112 and the rod guides 118 are assembled with the manifold 102, while no air remains in the bottomed holes 106, the recesses 128, or the air-relief holes 130. A volume of the working fluid used in the first step shown in FIG. 3A is so determined as to reach respective upper ends of the bottomed holes 106 in the state shown in FIG. 3B. The first step shown in FIG. 3A in which the bottomed holes 106 and the communication passages 108 of the manifold 102 are filled with the working fluid, corresponds to a fluid-charging step; and the second and third steps shown in FIGS. 3B and 3C in which the piston rods 112 are inserted in the bottomed holes 106 and the rod guides 118 are integrally fastened to the respective openings of the bottomed holes 106, correspond to an inserting and fastening step.

Figure 4A:
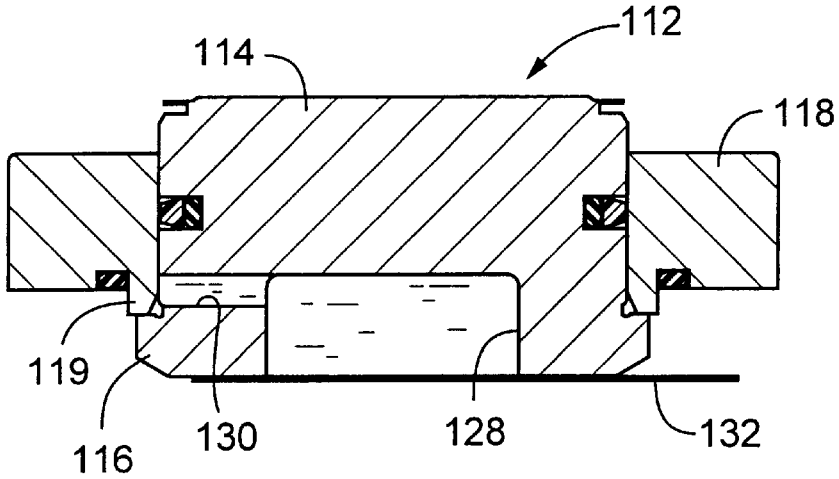
FIG. 4A is a view for explaining a first step of a second assembling method for assembling the apparatus of FIG. 1A.
Figure 4B:
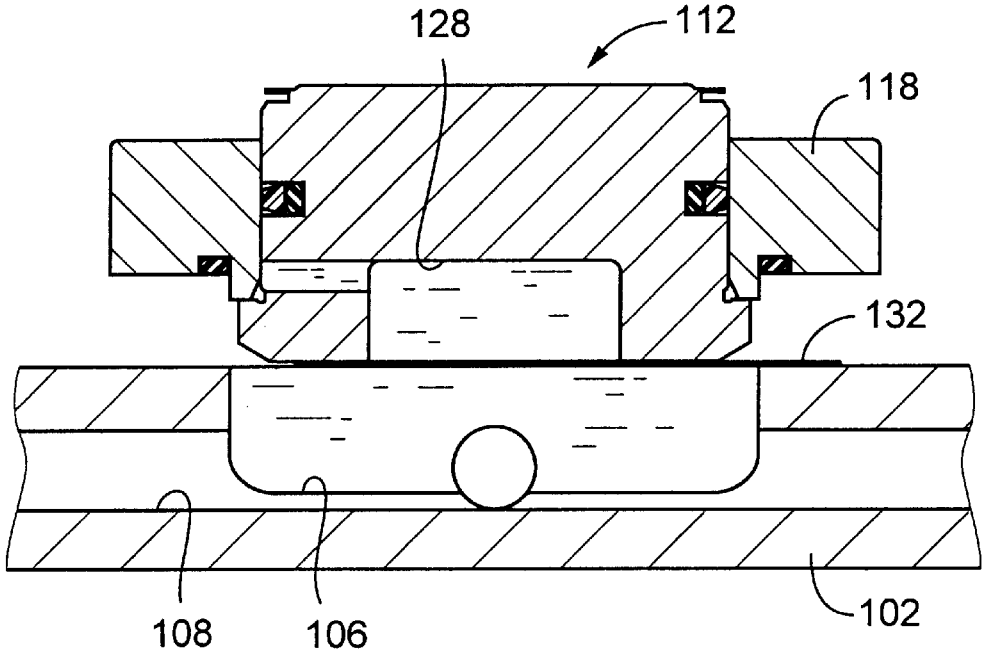
FIG. 4B is a view for explaining a second step of the second assembling method.

FIGS. 4A and 4B show two steps of a second assembling method. In the first step shown in FIG. 4A, each piston rod 112 is turned upside down, the recess 128 and the air-relief hole 130 are filled with the working fluid, and an opening of the recess 128 is closed by a thin sheet 132. The rod guide 118 is fitted, in advance, on the main portion 114 of the each piston rod 112, such that the projection 119 of the rod guide 118 is held in contact with the large-diameter portion 116 of the piston rod 112 and accordingly the opening of the air-relief hole 130 is closed by the rod guide 118. Meanwhile, the manifold 102 is held such that the bottomed holes 106 open upward, and the bottomed holes 106 and the communication passages 108 of the manifold 102 are filled with the working fluid. In the second step shown in FIG. 4B, the piston rod 112 and the rod guide 118 are turned upside down, again, so that the recess 128 is opposed to one bottomed hole 106. In a state in which the thin sheet 132 is contacted with, or immersed in, the working fluid filling the bottomed hole 106, the shin sheet 132 is pulled out, the projection 119 of the rod guide 118 is fitted in the bottomed hole 106, and the rod guide 118 is integrally fastened to the manifold 102 with the bolts 120. In this case, too, the piston rods 112 and the rod guides 118 can be assembled with the manifold 102, while no air remains in the bottomed holes 106, the recesses 128, or the air-relief holes 130. However, according to this assembling method, each piston rod 112 need not have the air-relief hole 130. The first step shown in FIG. 4A in which the respective recesss 128 and the respective air-relief holes 130 of the piston rods 112 are filled with the working fluid and the bottomed holes 106 and the communication passages 108 of the manifold 102 are filled with the working fluid, corresponds to the fluid-charging step; and the second step shown in FIG. 4B in which the thin sheets 132 are pulled out, the respective projections 119 of the rod guides 118 are fitted in the bottomed holes 106, and the rod guides 118 are integrally fastened to the manifold 102, correspond to the inserting and fastening step. The thin sheets 132 correspond to closing members.

Back to FIG. 2B, in the state in which the piston rod 112 is positioned at its forced-movement (i.e., downward-movement) end position, shown in the right-hand half of the figure, an upper end of the piston rod 112 somewhat projects upward from an upper end 134 of the rod guide 118, and supports an annular dust seal 136 as a covering device that is formed of a stretchable, thin, elastic material (e.g., rubber). As is apparent from the enlarged view of the dust seal 136, shown in FIG. 5, the piston rod 112 has, in its upper end portion, a considerably deep, annular groove 138 in which an inner peripheral portion 140 of the dust seal 136 is fitted in the annular groove 138. The piston rod 112 has, in its upper end surface, a support surface 144 whose diameter is smaller than a diameter of the bottom of the annular groove 138 and which somewhat projects upward from a remaining portion of the upper end surface. The support surface 144 supports one cushion pin 22. Even if the support surface 144 may be buckled by the impact produced in the pressing operation, the cushion pin 22 is prevented from contacting and damaging the dust seal 136.

In addition, when the piston rod 112 is moved upward and downward, an outer peripheral portion 142 of the annular dust seal 136 is kept, owing to its own weight, in contact with the upper surface 134 of the rod guide 118. Thus, the dust seal 136 prevents foreign matters from entering an interface of respective sliding surfaces (i.e., respective fitting surfaces) of the piston rod 112 and the rod guide 118. In the state in which the piston rod 112 is positioned at its forced-movement end position, the dust seal 136 is substantially positioned in a plane extending along the upper surface 134 substantially perpendicular to an axis line (i.e., a centerline) of the piston rod 112. An initial shape of the dust seal 136, i.e., a formed shape of the dust seal 136 is so determined as to be positioned in a plane. However, when the piston rod 112 is moved upward to its advancement-movement end position, the dust seal 136 is elastically deformed, owing to its own weight, into a truncated conical shape, as shown in the left-hand half of FIG. 2B, while the outer peripheral portion 142 of the dust seal 136 is kept in contact with the upper end surface 134 of the rod guide 118.

Each of the inner and outer peripheral portions 140, 142 of the dust seal 136 has a thickness greater than that of a remaining portion of the seal 136. In the present embodiment, each of the two portions 140, 142 is provided by a circular lip which has a substantially circular cross section and is equally thickened on both sides of the remaining portion of the seal 136. The circular lip as the inner peripheral portion 140 increases the strength of the dust seal 136 as a whole, thereby allowing the seal 136 to be easily fitted in the annular groove 138 and effectively preventing the seal 136 from coming off the groove 138. The circular lip as the outer peripheral portion 142 increases the weight of the dust seal 136 as a whole, thereby allowing the seal 136 to be tightly placed on the upper end surface 134 of the rod guide 118 and more effectively preventing foreign matters from entering. In FIG. 2B, the inner or outer peripheral portion 140, 142 is not shown.

Figure 11:
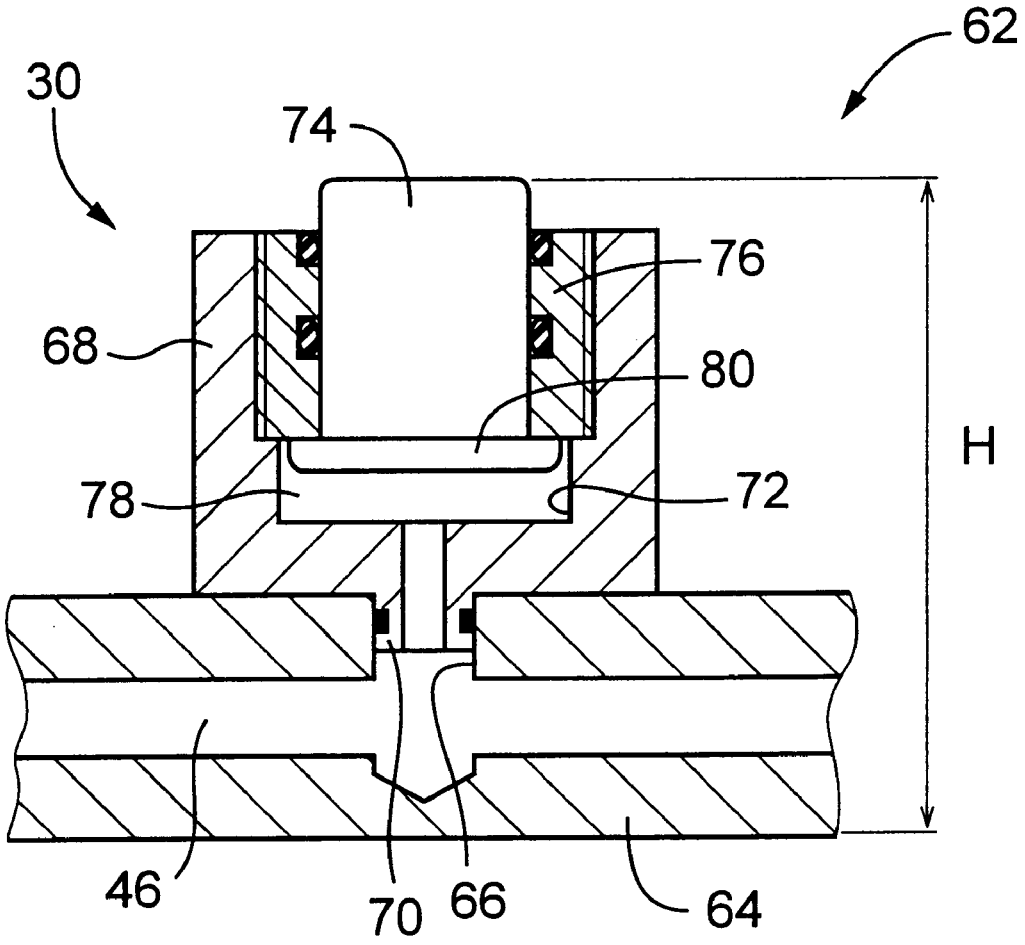
FIG. 11 is a cross-sectioned view of a conventional equalizing fluid-operated apparatus.

As is apparent from the foregoing description of the present embodiment, the equalizing fluid-operated apparatus 100 employs the manifold 102 which has the bottomed holes 106 functioning as the respective pressure chambers of the hydraulic cylinders 104, and additionally employs the rod guides 118 which are integrally fixed to the respective openings of the bottomed holes 106 and hold the respective piston rods 112 such that the piston rods 112 are slideable relative to the rod guides 118 and are prevented from coming off the same 118. Therefore, a height H of the whole equalizing fluid-operated apparatus 100 including the manifold 102 (this height H is illustrated FIG. 2B) is smaller than the height H of the conventional apparatus 62 (this height H is illustrated in FIG. 11). Thus, the present apparatus 100 can be employed, as it is, by more conventional pressing machines.

In addition, since the manifold 102 provides the respective housings of the hydraulic cylinders 104, the pressure-receiving area As of the piston rod 112 of each of the cylinders 104, i.e., the diameter of the main portion 114 of the piston rod 112 that is held by the rod guide 118 can be increased without having to lower the density of distribution of the cylinders 104. Accordingly, the hydraulic pressure $Ps_0$ can be lowered as such, and respective required strengths or sealing performances of the various members can be lowered as such. For example, it is possible to use a middle-range pressure (i.e., a pressure not higher than $350\times9.8\times10^4$ Pa) depending upon employed working conditions.

In addition, since the piston rods 112 have, in their end surfaces, the respective recesses 128 which cooperate with each other to accommodate the prescribed volume V of working fluid, the apparatus 100 can employ the thin manifold 102 having the shallow bottomed holes 106 and therefore can enjoy the decreased height H thereof. Moreover, the volume V of working fluid can be adjusted, depending upon the wrinkling-preventing load Fs, the number of the cushion pins 22 used, and/or the modulus of elasticity of volume K of the working fluid, by using the same manifold 102 but changing the dimensions of the recess 128 of each piston rod 112.

In addition, since each piston rod 112 has the air-relief hole 130 which communicates, at its one end, with the recess 128 and opens, at the other end, the side surface of the rod 112, the piston rod 112 and the rod guide 118 can be easily assembled with the manifold 102 whose bottomed holes 106 are filled, in advance, with the working fluid, without leaving any air in the recess 128, as shown in FIGS. 3A, 3B, and 3C.

Moreover, each piston rod 112 has, in its free end portion, the annular groove 138 in which the inner peripheral portion 140 of the annular dust seal 136, formed of the thin, elastic material, fits. Since the outer peripheral portion 142 of the dust seal 136 can be held, owing to its own weight, in contact with the upper end surface 134 of the rod guide 118, even when the piston rod 112 is moved upward and downward, foreign matters can be effectively prevented from entering the interface of respective sliding surfaces of the piston rod 112 and the rod guide 118. Thus, oil leakage that may result from scars or scratches produced by the foreign matters can be prevented, and accordingly the life expectancy of the apparatus 100 is increased.

In addition, since the dust seal 136 is provided by the thin, annular member that is formed of the elastic material to be positioned in a plane, the seal 136 can be produced with ease and at low cost. Moreover, each dust seal 136 can be easily attached to the piston rod 112, and can be easily exchanged with another dust seal, by just fitting the inner peripheral portion 140 of each seal 136 in the annular groove 138 of the piston rod 112.

Moreover, since each of the inner and outer peripheral portions 140, 142 of each dust seal 136 is provided by the thickened circular lip having the circular cross section, the inner peripheral portion 140 enjoys the increased strength which assures that the inner peripheral portion 140 can be easily fitted in the annular groove 138 of the piston rod 112 and can be effectively prevented from coming off the groove 138. In addition, the outer peripheral portion 142 enjoys the increased weight which assures that the outer peripheral portion 142 is held in close contact with the upper end surface 134 of the rod guide 118 and can effectively prevent foreign matters from entering the interface of the piston rod 112 and the rod guide 118.

In addition, since in the present embodiment each piston rod 112 supports, in its outer circumferential surface, the rod seal 124, the rod guide 118 can enjoy the sufficient strength without having to increase the thickness of its wall, thereby assuring that the present apparatus 100 can enjoy a compact construction.

Next, there will be described other embodiments of the present invention.

Figure 6A:
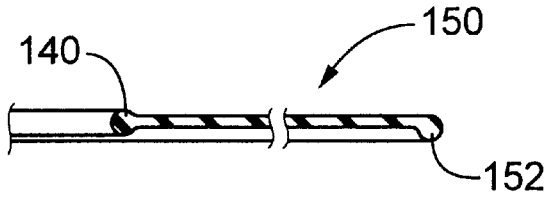
FIG. 6A is a view of another dust seal.
Figure 6B:
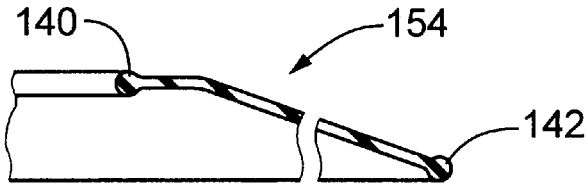
FIG. 6B is a view of another dust seal.
Figure 6C:
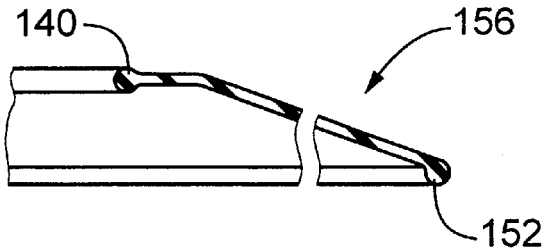
FIG. 6C is a view of another dust seal.

FIGS. 6A, 6B, and 6C show other dust seals each of which can be attached to the annular groove 138 of each piston rod 112 in place of each dust seal 136. More specifically described, FIG. 6A shows a dust seal 150 which has, like the dust seal 136, an initial shape formed to be positioned in a substantially flat plane and includes an inner peripheral portion 140 provided by the thickened "circular" lip having the circular cross section. However, an outer peripheral portion 152 of the dust seal 150 is provided by a "semi-circular" lip that is thickened on only a lower surface thereof to contact the upper end surface 134 of the rod guide 118. This design prevents foreign matters or dust from accumulating on the dust seal 150, and additionally prevents the outer peripheral portion 152 from warping upward, thereby improving the performance of the seal 150. More specifically described, when the piston rod 112 is moved upward and downward, the diameter of the outer peripheral portion 152 decreases and increases. In particular, when the piston rod 112 is moved downward and the diameter of the outer portion 152 increases, the outer portion 152 may be warped upward because of the resistance to the downward movement. However, since, according to this design, the outer peripheral portion 152 is thickened on its lower surface only and accordingly has a generally L-shaped cross section, the outer portion 152 is prevented, owing to its own elasticity, from being warped upward, i.e., toward its opposite side.

FIG. 6B shows a dust seal 154 which has the same inner and outer peripheral portions 140, 142 as those of the dust seal 136 and each of which is provided by the thickened circular lip. However, the dust seal 154 has a truncated conical, formed or initial shape corresponding to its standard state in which the large-diameter portion 116 of each piston rod 112 is positioned at its advancement (i.e., upward-movement) end position at which the portion 116 contacts the rod guide 118, as shown in the left-hand half of FIG. 2B. In addition, FIG. 6C shows a dust seal 156 which has the same inner and outer peripheral portions 140, 152 as those of the dust seal 150 and which has the same truncated conical formed shape corresponding to its standard state in which each piston rod 112 is positioned at its advancement end position. Each of the dust seals 154, 156 can be better stretched and shrunk to follow the upward and downward displacement of the piston rod 112, and the outer peripheral portion 142, 152 thereof can be better held in close contact with the upper end surface 134 of the rod guide 118, and can more effectively prevent foreign matters from entering the interface of respective sliding surfaces of the piston rod 112 and the rod guide 118.

If the dust seal 154, 156 is formed of an appropriate material, the dust seal 154, 156 can operate such that when the piston rod 112 is displaced upward and downward, the outer peripheral portion 142, 152 is kept still at the prescribed position on the upper end surface 134 and only an intermediate portion of the dust seal 154, 156 is elastically deformed to accommodate the upward and downward displacement of the piston rod 112. In this case, in place of the manner in which the outer peripheral portion 142, 152 is placed owing to its own weight only on the upper end surface 134, it is possible to employ an optional manner in which the outer peripheral portion 142, 152 is fixed to, and held in close contact with, the upper end surface 134, for example, a manner in which an annular groove is formed in the upper end surface 134 and the outer portion 142, 152 is fitted in, and fixedly attached to, the annular groove, or a manner in which the outer portion 142, 152 is fixed to the upper end surface 134 with a fixing means such as bolts.

In each of the embodiments illustrated in FIGS. 6A, 6B, and 6C, each of the inner peripheral portion 140 and the outer peripheral portion 142, 152 is provided by the thickened portion. However, it is possible that either one of the inner peripheral portion 140 and the outer peripheral portion 142, 152 be provided by the thickened portion. Otherwise, it is possible to employ dust seals each of which has a constant thickness over its entirety and accordingly does not include any thickened portions.

Figure 7:
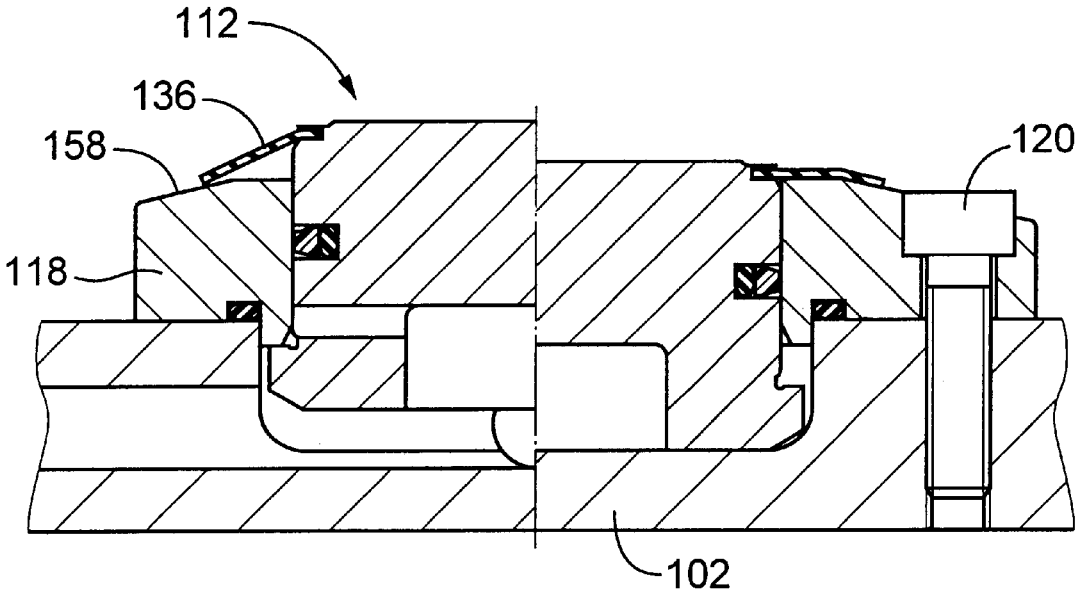
FIG. 7 is a cross-sectioned view corresponding to FIG. 2B, showing a guide rod of another fluid-operated cylinder, the guide rod having a tapered upper-end surface.

FIG. 7 corresponds to FIG. 2B, and shows a different rod guide 118 which has, in place of the horizontal upper end surface 134, a tapered upper end surface 158 which is inclined downward in a direction away from the piston rod 112. This design allows foreign matters, e.g., oil or dust, to slip down in radially outward directions without being accumulated on the dust seal 136 or the upper surface 158, and accordingly more effectively prevent the foreign matters from entering the interface of respective sliding surfaces of the piston rod 112 and the rod guide 118. The entirety of the upper end surface 158 may be tapered, but it is preferred that as illustrated in FIG. 7, the inner peripheral portion of the upper end surface 158 that is covered by the dust seal 136 be horizontal like the upper end surface 134 employed in the embodiment shown in FIG. 2B.

In addition, in the equalizing fluid-operated apparatus shown in FIG. 7, the bolts 120 are provided outside the dust seal 136. Therefore, the bolts 120 can be attached to, and detached from, the rod guide 118, with the dust seal 136 being attached to the piston rod 112, and the piston rod 112 and the rod guide 118, assembled with each other, can be attached to, and detached from, the manifold 102. In contrast, in the embodiment shown in FIG. 2B, an outer peripheral portion of the dust seal 136 covers the bolts 120, and accordingly it is needed to attach and detach the bolts 120 to and from the rod guide 118, in a state in which the dust seal 136 has not been attached to the piston rod 112 yet, or in a state in which the outer peripheral portion of the dust seal 136 is peeled off the rod guide 118.

Figure 5:
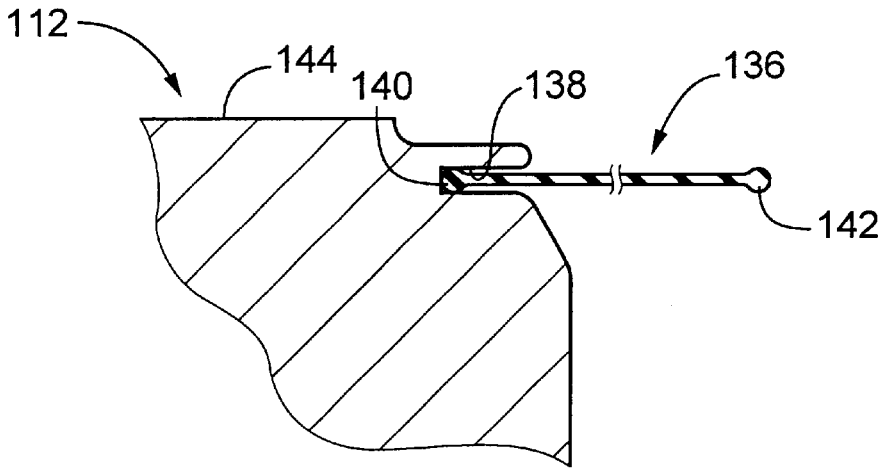
FIG. 5 is an enlarged, cross-sectioned view of a dust seal and a dust-seal supporting portion of a piston rod of the fluid-operated cylinder of FIG. 2A.
Figure 8:
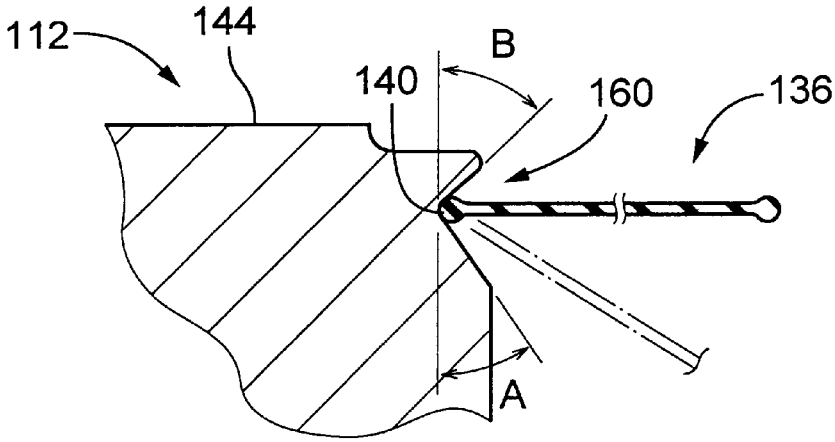
FIG. 8 is a cross-sectioned view corresponding to FIG. 5, showing a dust-seal supporting portion of a piston rod of another fluid-operated cylinder.

FIG. 8 corresponds to FIG. 5, and shows a different piston rod 112 which has, in its upper end portion, an annular V-groove 160 having a V-shaped cross section whose open angle is a considerably great. The inner peripheral portion 140 of the dust seal 136 fits in the annular V-groove 160. A bottom portion of the V-groove 160 has an arcuate shape having the same radius of curvature as that of the thickened circular lip of the inner peripheral portion 140. When the piston rod 112 is displaced upward and downward, the dust seal 136 is elastically deformed to be pivoted about the inner peripheral portion 140 between two positioned indicated at solid line and one-dot chain line, respectively. It is preferred that an angle A of a lower wall of the V-groove 160 with respect to a vertical line extending through the center of pivotal movement of the dust seal 136 be not greater than 30 degrees in view of the ease of attachment of the rod seal 124, and that an angle B of an upper wall of the V-groove 160 with respect to the vertical line be not smaller than 45 degrees in view of the need to prevent the inner peripheral portion 140 from coming off the groove 160.

Figure 9:
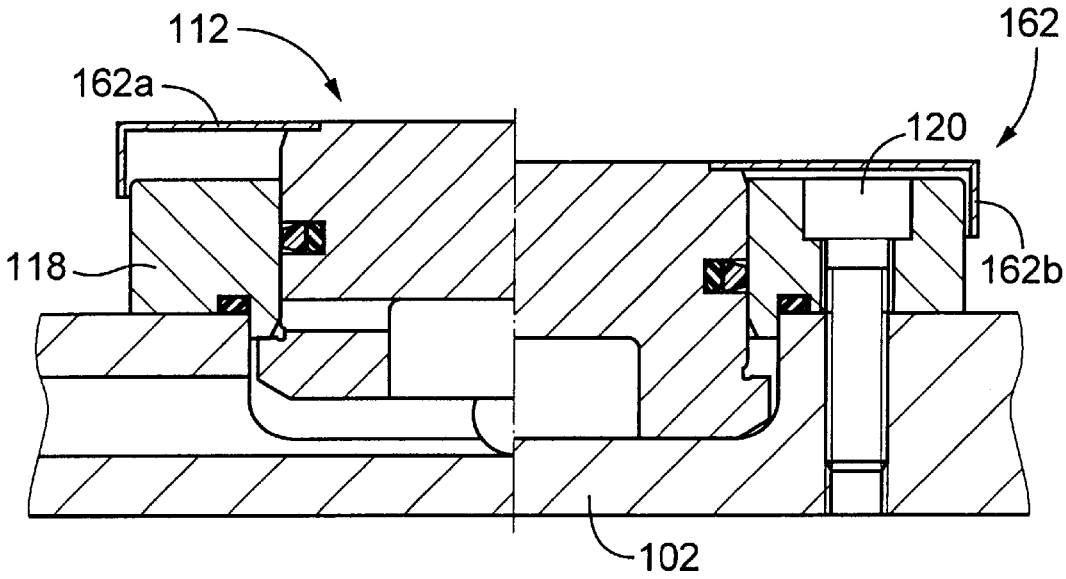
FIG. 9 is a cross-sectioned view-corresponding to FIG. 2B, showing another fluid-operated cylinder which employs a dust cover in place of a dust seat.

FIG. 9 corresponds to FIG. 2B, and shows a different piston rod 112 which has, in place of the dust seal 136, a dust cover 162 which is integrally fixed to an upper end portion of the rod 112 and which is formed of a metal to have a container-like shape having a partial bottom portion, a rectangular cross section, and an opening. More specifically described, the dust cover 162 includes a partial bottom wall 162*a* which extends from the outer peripheral portion of the piston rod 112 and reaches a position corresponding to an outer periphery of the rod guide 118; and a rectangular side wall 162*b* which is integral with the bottom portion 162*a*, extends downward from an outer periphery of the bottom wall 162*a* along the outer periphery of the rod guide 118, and has a shape corresponding to the shape of the outer periphery of the guide 118. The bottom portion 162*a* has, in its central portion, a through-hole whose diameter is substantially equal to that of the upper end surface of the piston rod 112, and is fitted in a stepped portion of the rod 112 such that the upper end surface of the rod 112 is exposed through the central through-hole of the bottom portion 162*a*. The cushion pin 22 is supported by the exposed upper end surface of the piston rod 112. In this case, there is left a certain amount of space between the dust cover 162 and the rod guide 118, and accordingly the performance of the dust cover 162 to prevent foreign matters such as dust from entering the interface of respective sliding surfaces of the piston rod 112 and the rod guide 118 is lower than that of the dust seal 136. However, it is possible to provide, as needed, an elastically stretchable seal member such as a rubber member for fluid-tight sealing between an open lower end of the side wall 162*b* and the outer circumferential surface of the rod guide 118. The bolts 120 need to be attached to, and detached from, the rod guide 118, in a state in which the dust cover 162 is not attached to the piston rod 112. The dust cover 162 may be integrally fixed to the piston rod 112 by a fixing means such as screws.

While the present invention has been described in its preferred embodiments by reference to the drawings, it is to be understood that the invention may be embodied with other changes, improvements, and modifications that may occur to a person skilled in the art without departing from the spirit and scope of the invention defined in the appended claims.

What is claimed is:

1. An equalizing fluid-operated apparatus for use with a pressing machine including a pressing die; a cushion pad to which a prescribed movement resistance is applied by a wrinkling-preventing-load applying device; a plurality of fluid-operated cylinders which are provided on the cushion pad and are filled with a working fluid and which have respective piston rods, and respective pressure chambers communicated with each other; a wrinkling-preventing die; and a plurality of cushion pins which are provided between the corresponding piston rods of the fluid-operated cylinders and the wrinkling-preventing die, so that when the wrinkling-preventing die cooperates with the pressing die to sandwich a workpiece owing to the movement resistance applied to the cushion pad, the respective piston rods of the fluid-operated cylinders are forced into the corresponding pressure chambers thereof to take respective neutral positions in the pressure chambers, and the working fluid applies substantially equal wrinkling-preventing loads to the workpiece via the respective cushion pins, the apparatus comprising:

a flat common manifold which is provided on the cushion pad and which has a plurality of bottomed holes having respective bottoms, and a communication passage that communicates the bottomed holes with each other;

a plurality of rod guides which are integrally and fixedly provided around respective openings of the bottomed holes of the manifold, such that each of the rod guides guides a movement of the piston rod of a corresponding one of the fluid-operated cylinders in a direction parallel to an axis line of said piston rod, and prevents said piston rod from coming off said one fluid-operated cylinder; and the bottomed holes and the communication passage of the manifold being filled with the working fluid, so that the bottomed holes function as the respective pressure chambers of the fluid-operated cylinders.

2. An apparatus according to claim 1, wherein the piston rod of each of the fluid-operated cylinders has, in an end surface thereof located on a side of a corresponding one of the bottomed holes, a recess which accommodates a prescribed volume of the working fluid.

3. An apparatus according to claim 2, wherein the piston rod of said each fluid-operated cylinder has an air-relief hole which communicates, at one of opposite ends thereof, with a bottom of the recess and opens, at the other end thereof, in a side surface of the piston rod.

4. An apparatus according to claim 1, wherein the fluid-operated cylinders are supported by the cushion pad of the pressing machine such that an upper end portion of the piston rod of each of the fluid-operated cylinders projects vertically upward from a corresponding one of the rod guides, and wherein the apparatus further comprises a covering device which is provided on the upper end portion of the piston rod of said each fluid-operated cylinder that projects vertically upward from said one rod guide and which prevents foreign matters from entering an interface of respective sliding surfaces of said piston rod and said one rod guide.

5. An apparatus according to claim 4, wherein the covering device comprises a dust cover which includes a bottom portion that extends outward from the piston rod of said each fluid-operated cylinder and reaches a position corresponding to an outer periphery of said one rod guide, and additionally includes a tubular side portion that is integral with the bottom portion, extends downward from an outer periphery of the bottom portion along a side surface of said one rod guide, and has a shape corresponding to a shape of the side surface of said one rod guide.

6. An apparatus according to claim 4, wherein the covering device comprises an annular dust seal which is formed of a stretchable thin elastic material, which includes an inner peripheral portion that is attached to an outer peripheral portion of the upper end portion of the piston rod of said each fluid-operated cylinder, and additionally includes an outer peripheral portion that is held in contact with said one rod guide even when said piston rod is displaced upward and downward, and which prevents said foreign matters from entering the interface of the respective sliding surfaces of said piston rod and said one rod guide.

7. An apparatus according to claim 6, wherein the piston rod of said each fluid-operated cylinder has, in an side surface thereof, an annular groove, and wherein the inner peripheral portion of the dust seal is fitted in, and attached, to, the annular groove, and the outer peripheral portion of the dust seal is held, owing to an own weight thereof, in contact with an upper end surface of said one rod guide even when said piston rod is displaced upward and downward.

8. An apparatus according to claim 6, wherein at least one of the inner and outer peripheral portions of the dust seal comprises a thickened portion having a thickness greater than a thickness of a remaining portion of the dust seal.

9. A method of assembling an equalizing fluid-operated apparatus according to claim 1, comprising the steps of:

holding the manifold such that the bottomed holes thereof open upward, so as to fill the bottomed holes and the communication passage of the manifold with the working fluid, and inserting each of the piston rods into a corresponding one of the bottomed holes filled with the working fluid, without leaving air in said one bottomed hole, and fixing a corresponding one of the rod guides to a portion of the manifold around an opening of said one bottomed hole.

10. A method of assembling an equalizing fluid-operated apparatus according to claim 2, comprising the steps of:

holding the manifold such that the bottomed holes thereof open upward, so as to fill the bottomed holes and the communication passage of the manifold with the working fluid, filling the recess of each of the piston rods with the working fluid, and closing, with a closing member, an opening of the recess of said each piston rod, and moving said each piston rod to a position above a corresponding one of the bottomed holes, in a state in which the recess of said each piston rod filled with the working fluid is oriented downward, removing the closing member in a state in which the closing member contacts, or is immersed in, the working fluid filling said one bottomed hole, inserting said each piston rod into said one bottomed hole, and fixing a corresponding one of the rod guides to a portion of the manifold around an opening of said one bottomed hole.

11. A method of assembling an equalizing fluid-operated apparatus according to claim 3, comprising the steps of:

holding the manifold such that the bottomed holes thereof open upward, so as to fill the bottomed holes and the communication passage of the manifold with the working fluid, and inserting each of the piston rods into a corresponding one of the bottomed holes filled with the working fluid, till the air-relief hole of said each piston rod is immersed in the working fluid filling said one bottomed hole, while allowing air to be relieved from the air-relief hole and the recess of said each piston rod and allowing the working fluid to flow into said recess and said air-relief hole, and fixing a corresponding one of the rod guides to a portion of the manifold around an opening of said one bottomed hole.

* * * * *